US009321091B2

(12) United States Patent
Tsuchiya et al.

(10) Patent No.: US 9,321,091 B2
(45) Date of Patent: Apr. 26, 2016

(54) MANUFACTURING METHOD OF SIDE PANEL

(75) Inventors: Takashi Tsuchiya, Tochigi (JP); Teruo Kamada, Tochigi (JP); Daisuke Yamamoto, Tochigi (JP); Kaoru Hirotani, Tochigi (JP); Kenji Matsutani, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 81 days.

(21) Appl. No.: 13/455,305

(22) Filed: Apr. 25, 2012

(65) Prior Publication Data

US 2012/0272707 A1 Nov. 1, 2012

(30) Foreign Application Priority Data

Apr. 28, 2011 (JP) ..... 2011-100685

(51) Int. Cl.
*B21D 22/02* (2006.01)
*B21D 53/88* (2006.01)

(52) U.S. Cl.
CPC ..... *B21D 22/02* (2013.01); *B21D 53/88* (2013.01); *Y10T 29/49622* (2015.01)

(58) Field of Classification Search
CPC ..... B21D 22/30; B21D 5/02; B21D 39/031; B21D 22/20; B21D 28/06; B21D 39/03; B21D 53/88; B21B 1/227; A61F 2002/9522
USPC ..... 72/347, 348, 379.2, 336, 363; 29/446, 29/521, 283.5, 505, 897.2
See application file for complete search history.

(56) References Cited

U.S. PATENT DOCUMENTS

| | | | | |
|---|---|---|---|---|
| 3,241,350 | A * | 3/1966 | Giordano | 72/412 |
| 5,532,450 | A * | 7/1996 | Iwai et al. | 219/121.63 |
| 6,282,790 | B1 * | 9/2001 | Jaekel et al. | 29/897.2 |
| 6,547,895 | B2 * | 4/2003 | Bradley et al. | 148/535 |
| 7,143,514 | B2 * | 12/2006 | Kamada et al. | 29/897.2 |
| 7,568,272 | B2 * | 8/2009 | Morita et al. | 29/430 |
| 7,857,349 | B2 * | 12/2010 | Fujiki et al. | 280/785 |
| 8,257,516 | B2 * | 9/2012 | Im et al. | 148/647 |
| 2005/0115300 | A1 * | 6/2005 | Morita et al. | 72/379.2 |
| 2008/0258450 | A1 * | 10/2008 | Fujiki et al. | 280/788 |
| 2009/0178458 | A1 * | 7/2009 | Toeniskoetter | 72/379.2 |

FOREIGN PATENT DOCUMENTS

JP 59-220229 12/1984

* cited by examiner

*Primary Examiner* — David Bryant
*Assistant Examiner* — Lawrence Averick
(74) *Attorney, Agent, or Firm* — Rankin, Hill & Clark LLP

(57) ABSTRACT

A side panel including a first member and a second member having a higher strength is manufactured by arranging a corner portion of the second member in a recessed portion of the first member, and by simultaneously press-working the first member and the second member.

11 Claims, 5 Drawing Sheets

MANUFACTURING METHOD OF SIDE PANEL

BACKGROUND OF THE INVENTION

1. Field of the Invention

The present invention relates to a method for manufacturing a side panel.

2. Related Art

According to a press working method, various kinds of products having various shapes can be manufactured by a relatively simple process. Accordingly, the press working method has been widely utilized in many fields. When the press working method is utilized, basically, a single sheet of material, for example, a metal plate is used for a single kind of products.

However, there is a case where an area of a portion to be punched out by a press working is too wide or a shape, a material quality and a sheet pressure of a product to be obtained is special. In such a case, there is a problem that a proportion of waste material out of a material to be pressed highly increases and a yield ratio of the material is lowered. In this regard, JP-A-59-220229 discloses a processing method in which a plurality of members to be pressed are combined and integrally welded, and then press-worked to obtain a final product.

Further, in an automobile industry required for a mass production, a tailor welded blank method in which materials having desired properties are placed on desired regions has been adapted. According to the tailor welded blank method, materials which have a desired material quality and sheet thickness different from each other can be combined as a blank material. Then, the combined blank material is integrally formed by a welding and press-worked by a press machine to obtain a final product. By doing so, a desired press working can be performed by single press working.

However, when the tailor welded blank method is adapted, the problem is as follows. Regarding to this problem, a case of manufacturing a side panel in a vehicle will be described as an example by referring to FIG. 4 and FIG. 5.

A side panel 300 illustrated in FIG. 4 includes an upper member 100 and a lower member 200 which have strengths different from each other. In the side panel 300 illustrated in FIG. 4, the upper member 100 includes a front pillar portion 101, a loop pillar portion 102 and a rear pillar portion 103. Meanwhile, the lower member 200 is constituted by a side sill which extends from a lower side of the side panel 300 to a rear fender. The side sill includes a side sill front portion 201 connected to the lower side of the side panel 300, a side sill main portion 202 and a side sill rear portion 203 connected to the front pillar portion 103 and a wheel portion of the rear fender.

Generally, the upper member 100 of the side panel 300 is considered as a part having a focus on design. For this reason, the upper member is made of a relatively soft material to obtain good formability. Meanwhile, the lower member 200 of the side panel 300 is made of a material which has a higher strength than the upper member 100 in order to obtain to a safety during driving or collision.

The upper member 100 and the lower member 200 of the side panel 300 are joined to each other by welding a joined part A between the rear pillar portion 101 and the side sill front portion 201 and a joined part B between the front pillar portion 103 and the side sill rear portion 203.

A material of the lower member 200 of the side panel 300 has a higher strength than a material of the upper member 100 of the side panel 300. Accordingly, when the material of the upper member 100 and the material of the lower member 200 of the side panel 300 are press-worked, it is necessary to apply higher press load on the material of the lower member 200 having a high strength than the material of the upper member 100.

Meanwhile, if the material of the side panel 300 is press-worked while being placed on a press machine in a state where a center portion of the press area is positioned near a center portion of the material of the side panel 300, the material of the lower member 200 required for a high press load is arranged at a position offset downward from the press machine. For this reason, when the material of the upper member 100 and the material of the lower member 200 of the side panel 300 are simultaneously press-worked, a bias is caused in the press load and therefore a processing surface of a mold forming a press surface is inclined. Consequently, there is a problem which a suitable press working cannot be achieved for the side panel 300.

For this reason, although the man hour increases, in order to securely perform the press working, the metal plate 100A of the upper member of the side panel 300 and the metal plate 200A of the lower member of the side panel 300 are subjected to a drawing work by a separate press machine and then processed metal plates 100B, 200B are shaped, as illustrated in FIG. 5. Subsequently, the processed metal plates 100B, 200B are further press-worked by a separate press machine to allow unnecessary portions thereof to be removed. By these processes, the upper members 100-1 to **100-*n* and the lower members 200-1 to 200-*n* are formed. The upper member 100 and the lower member 200 of the side panel 300** thus formed are joined to each other at the joined parts A, B using a spot welding and therefore the side panel is completed as a product.

It is theoretically not impossible to press-work a material of the upper member 100 and a material of the lower member 200 having a strength different from the material of the upper member at one time by single press machine. For example, when a metal plate having a high press load and a normal metal plate are simultaneously press-worked, it is enough to cause the press machine to apply a sufficient high press load to ignore the strength difference between pluralities of metal plate having strengths different from each other. However, in this case, since the load pressure of the press machine significantly increases and a large press machine is required, this is not economical.

SUMMARY OF THE INVENTION

One or more embodiments of the invention provide a side panel manufacturing method which is capable of simultaneously press-working a plurality of members with a low cost even if it is required to press-work the plurality of members with different press loads.

DETAILED DESCRIPTION OF THE EMBODIMENTS

Hereinafter, an embodiment will be described with reference to accompanying drawings. The embodiment and its modifications described herein are not intended to limit the invention but only to exemplify the invention, and all features or combinations of the features of the embodiment and its modifications are not always essential to the invention.

Now, a case where the manufacturing method of the embodiment is applied to manufacture a side panel of a vehicle will be described.

Figure 1A:
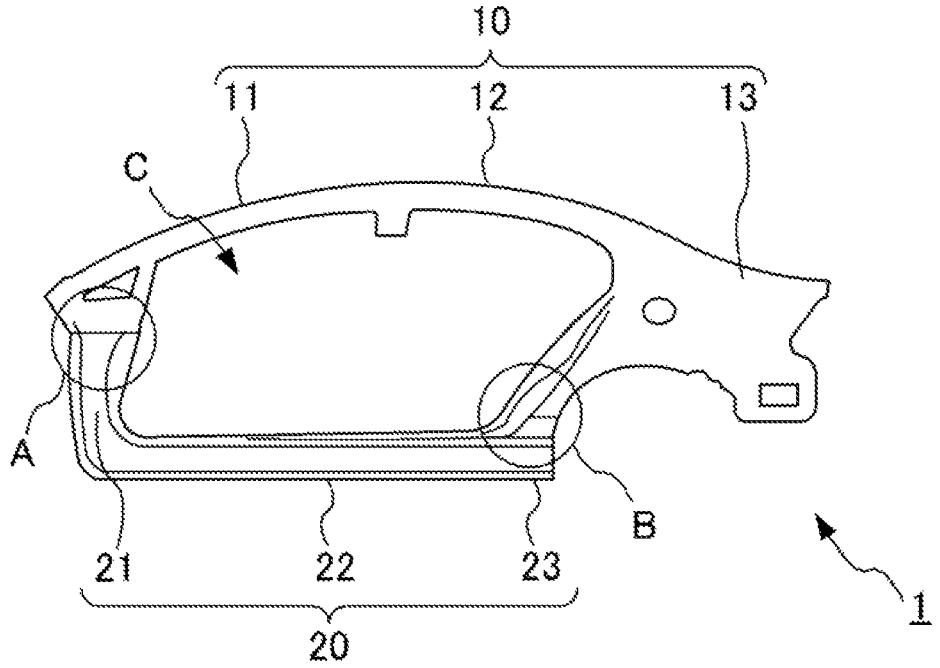
FIGS. 1(*a*) and 1(*b*) are views illustrating a manufacturing method of a side panel according to an embodiment.
Figure 1B:
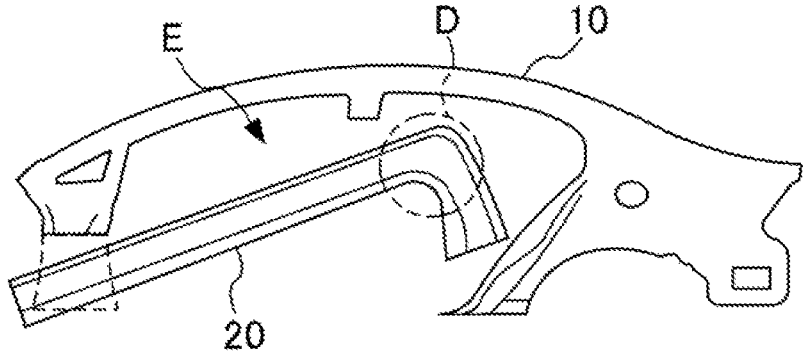

FIG. 1 illustrates a side panel that is manufactured by applying the manufacturing method.

As illustrated in FIG. 1 (*a*), the side panel 1 includes an upper member 10 and a lower member 20. The upper member 10 includes a front pillar portion 11, a loop pillar portion 12 and a rear fender portion 13. Meanwhile, in this embodiment, the lower member 20 is constituted by a side sill which extends from a lower side of the side panel 1 to the rear fender portion 13. The side sill includes a side sill front portion 21 connected to the front pillar portion 11, a side sill main portion 22 and a side sill rear portion 23 connected to the rear fender portion 13.

The side sill front portion 21 and the side sill main portion 22 are integrally connected to each other by an L-shaped portion. The upper member 10 and the lower member 20 are joined to each other by welding a joined part A between the front pillar portion 11 and the side sill front portion 21 and a joined part B between the rear fender portion 13 and the side sill rear portion 23. Further, the upper member 10 and the lower member 20 are connected to each other at the joined parts A, B and form an opening C therebetween for allowing a door to be installed.

Generally, the upper member 10 of the side panel 1 is considered as a part having a focus on design. For this reason, the upper member is made of a relatively soft material to obtain good formability. Meanwhile, the lower member 20 of the side panel 1 is made of a material which has a higher strength than the upper member 10 in order to obtain to a safety during driving or collision. In particular, it is necessary to maintain the strength of the L-shaped portion at a special high degree.

As illustrated in FIG. 1 (*a*), the upper member 10 and the lower member 20 of the side panel 1 are designed to form the opening C therebetween for allowing a door to be installed. For this purpose, as illustrated in FIG. 1 (*b*), the upper member 10 is formed with a recessed portion E and thus the opening C of the side panel 1 is formed by the upper member 10 and the lower member 20. As illustrated in FIG. 1 (*b*), according to the embodiment, a press working is performed in a state where the lower member 20 including the L-shaped portion (hereinafter, referred to as a corner portion) of the side sill is arranged within the recessed portion E the upper member 20 of the side panel 1. In general, the largest press load is applied near a load center of a press area in a press machine. From this point, according to the embodiment, it is possible to avoid the inclination of the press machine due to a bias of the press load by arranging the corner portion D of the lower member 20 having a high strength at a position of the largest press load near the load center of the press area in the press machine.

Hereinafter, the manufacturing method of the embodiment will be described.

Figure 2:
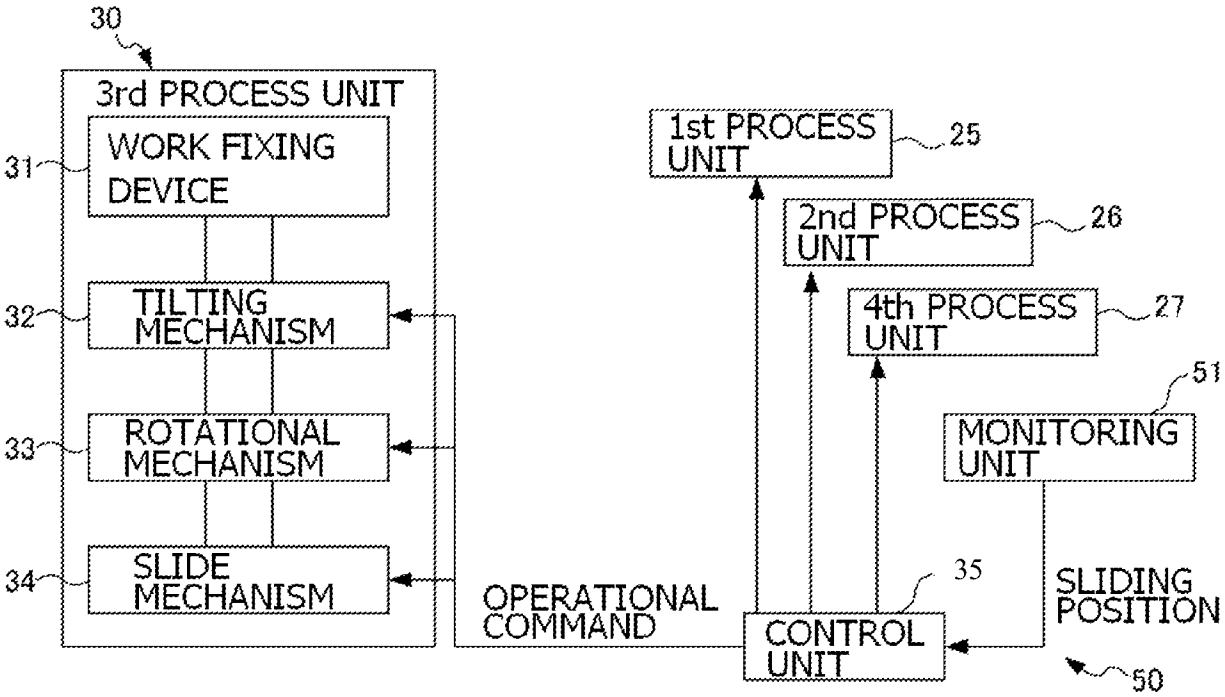
FIG. 2 is a view illustrating a schematic configuration of a manufacturing system for performing the manufacturing method of the embodiment.
Figure 3A:
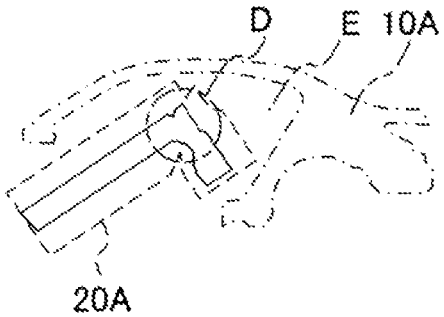
FIGS. 3(*a*) to 3(*d*) are views sequentially illustrating the manufacturing method of the embodiment.
Figure 3B:
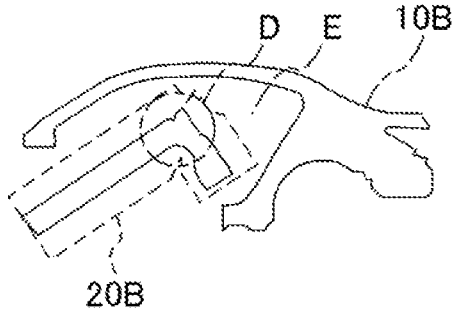
Figure 3C:
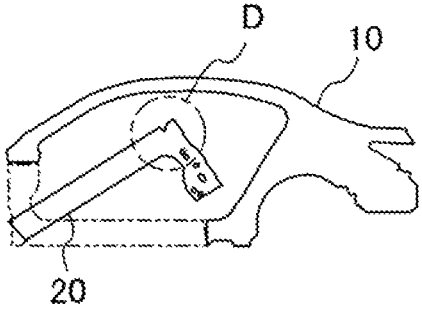
Figure 3D:
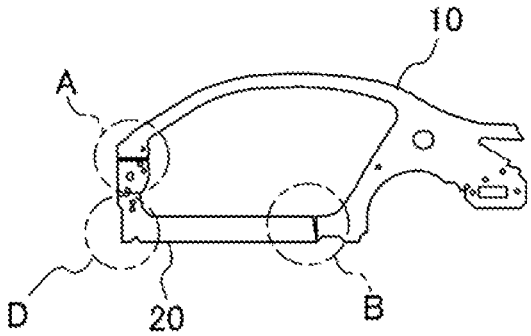
Figure 4:
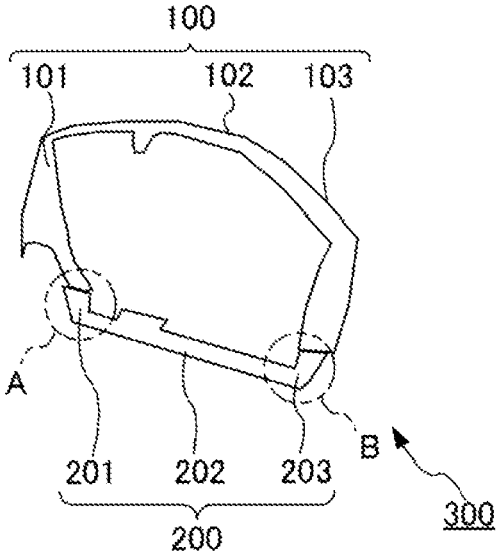
FIG. 4 is a view illustrating a configuration of a side panel.
Figure 5:
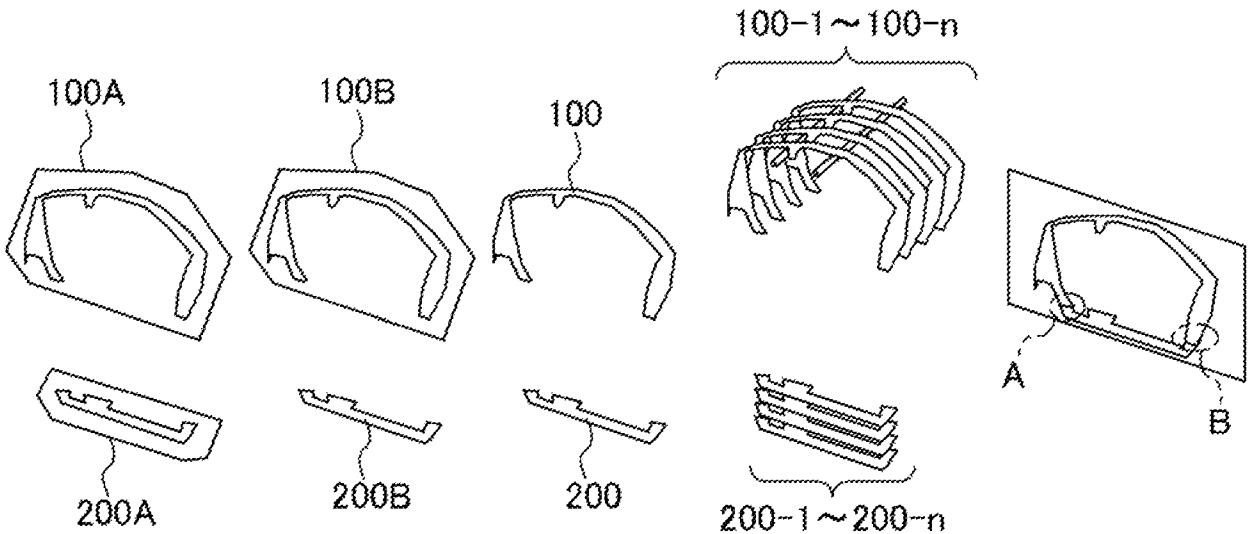
FIG. 5 shows views sequentially illustrating a manufacturing method of a side panel according to a related art.

FIG. 2 is a view illustrating a schematic configuration of a manufacturing system 50 for performing the manufacturing method of the present embodiment. The manufacturing system 50 includes a first process for performing a drawing work on each metal plate constituting the members of the side panel 1, a second process for removing unnecessary portions from the metal plate processed at the first process, a third process for rotationally moving the metal plate with unnecessary portions removed, thereby positioning the corner portion thereof at a predetermined position and a fourth process for caulking the metal plate arranged at the predetermined position, thereby temporarily fixing the metal plate.

The manufacturing system 50 has a third process unit 30 for performing the third process. The third process unit 30 includes a fixing device 31 for fixing various metal plates constituting the side panel 1, a tilting mechanism 32 for tilting the metal plates fixed by the fixing device 31, a rotational mechanism 33 for rotating the metal plate, a slide mechanism 34 for slidably moving the metal plate, and a control unit 35 for individually controlling the fixing device 31, the tilting mechanism 32, the rotational mechanism 33 and the slide mechanism 34.

In addition to the third process unit 30, the manufacturing system 50 further includes a first process unit 25 for performing the first process, a second process unit 26 for performing the second process and a fourth process unit 27 for performing the fourth process.

Further, the manufacturing system 50 includes a monitor unit 51 for monitoring the state of the metal plate at each of the first process, the second process, the third process and the fourth process. The monitor unit 51 is constituted by a camera or sensor, etc., and can obtain information required for performing the above process, such as a position or a state of the metal plate.

The control unit 35 is configured to control each of the first process unit 25, the second process unit 26 and the fourth process unit 27 as well as the third process unit 30, based on the information relating to the state of the metal plate obtained from the monitor unit 51.

By referring to FIG. 2 and FIG. 3, processing sequences of the metal plate in the manufacturing method of the present embodiment will be described.

In the present embodiment, as a material of the upper member in the side panel, a metal plate 10A having a normal strength is used, and as a material of the lower member in the side panel, a metal plate 20A having a higher strength than the metal plate 10A.

First, in the first process, as illustrated in FIG. 3 (*a*), the metal plate 10A and the metal plate 20A are arranged not to overlap each other. That is, as illustrated in dotted line, the metal plate 20A is arranged in the recessed portion E of the metal plate 10A not to overlap the metal plate 10A. Subsequently, in this arrangement, a drawing work of the metal plate 10A and the metal plate 20A is performed by the first process unit 25. This process is performed by a press machine (not illustrated).

In this process, the metal plate 10A is subjected to the drawing work to form a curved surface illustrated in dashed-dotted line. That is, the metal plate 10A is subjected to the drawing work to form the recessed portion E. Similarly, the metal plate 20A is also subjected to the drawing work to form a curved surface illustrated in solid line while being arranged within the recessed portion E of the metal plate 10A.

Subsequently, in the second process, unnecessary portions are removed from the metal plates 10B, 20B having the curved surface formed by the drawing work. This process is performed by a press machine (not illustrated). In this process, the upper member 10 and the lower member of the side panel 1 are respectively formed. Specifically, as illustrated in FIG. 3 (*b*), the metal plate 10B after the drawing work is subjected to a shearing work to form a curved surface illustrated in solid line. That is, a surface having the recessed portion E is formed in the metal plate 10B. Meanwhile, in the metal plate 20B after the drawing work, a curved surface (illustrated in solid line) having the corner portion D is formed in the interior of the recessed portion E of the metal plate 10B.

In the third process, as illustrated in FIG. 3 (*c*), the lower member 20 is tilted, rotated and slidably moved relative to the first member 10 with unnecessary portions removed. As a result, the lower member 20 is arranged at a predetermined position relative to the upper member 10 so that the lower member can be joined to the upper member at the joined portions A, B. In the third process, the press machine is not essential.

Specifically, first, the upper member 10 and the lower member 20 are fixed by the fixing device 31.

Next, the lower member 20 is tilted relative to the upper member 10 by the tilting mechanism 32 so that the lower member 20 is arranged not to interfere with the upper member 10. In this state, the lower member 20 is rotated relative to the upper member 10 by the rotational mechanism 33 to direct the corner portion D of the lower member 20 to a front side of the main body. Subsequently, the lower member 20 is moved by the slide mechanism 34 so that the lower member 20 is arranged at a predetermined position (illustrated in FIG. 3 (*d*)) relative to the upper member 10.

In the fourth process, in a state where the upper member 10 and the lower member 20 are arranged at a predetermined position illustrated in FIG. 3 (*d*) by the third process, the upper member 10 and the lower member 20 are caulked or pierced so that the upper member and the lower member are temporarily fixed at the joined portions A, B. This process may be performed by a press machine (not illustrated).

As mentioned above, in the manufacturing method of the above embodiment, the first member and the second member are simultaneously press-worked in a state where the high strength portion of the second member (lower member) is positioned near the center of the press load. Accordingly, it is possible to press-work the second member with a high strength at a position of the largest press load near the load center of the press area in the press machine. Further, since the press working is performed in a state where the second member is arranged in the recessed portion of the first member, a wide press area is not required. Accordingly, the first member and the second member having different strengths can be simultaneously press-worked without significantly increasing the load pressure of the press machine or requiring a large press machine. As a result, it is possible to provide a side panel manufacturing method capable of press working each of the members with a low cost.

The present invention is not limited to the above embodiments but can be variously modified without departing from the spirit of the present invention.

For example, the third process unit 30 is configured to tilt, rotate and slide the metal plate with unnecessary portions removed at the second process so that the corner portion is arranged in a predetermined position. However, the present invention is not limited to this case and the third process unit 30 may be utilized to suitably arrange two metal plates in such a way that the corner portion of one metal plate (as the second member) is introduced at a predetermined position within the recessed portion of the other metal plate (as the first member) before the first process is performed. Further, it is not essential that the third process unit 30 include the press machine. For example, the third process unit may be constituted with a robot.

Meanwhile, in the present embodiment, when the press working is performed, the upper member 10 and the lower member 20 are simultaneously press-worked in a state where the corner portion D of the lower member 20 is positioned near the center of the press load in the concave portion E of the upper member 10. However, the present invention is not limited to this case. Specifically, as long as a high strength region of the lower member 20 is positioned near the center of the press load or the whole or most of the lower member 20 is positioned at the interior of the concave portion E of the upper member 10, a region which is positioned at the center of the concave portion E of the upper member 10 or near the center of the press load is not limited to the corner portion D. This region can be changed depending on a mounting situation.

In addition, although the load center is positioned near the center of the press area in the present embodiment, the present invention is not limited to this case. When the load center is not positioned near the center of the press area, the press working may be performed in a fashion that a high strength member is positioned near the load center while not interfering a low strength member.

Further, although a case of manufacturing a side panel of a vehicle has been described as an example, the present invention is not limited to this case. The present invention is also applicable to a case of performing a press working two or more members having different strengths.

In accordance with the above described embodiments, a manufacturing method of a side panel (1), in which the side panel (1) includes a first member (10) and a second member (20) having a higher strength than the first member (10), the first member (10) and the second member (20) are joined to each other, an opening (C) to which a door is to be mounted is formed in a center part of the side panel (1), the first member (10) includes a recessed portion (E) to form the opening (C), and the second member (20) includes a corner portion (D), may include a step of simultaneously press-working a first work-piece (10A, 10B) as a material of the first member (10) and a second work-piece (20A, 20B) as a material of the second member (20), in a state where a portion of the second work-piece (20A, 20B) to be the corner portion (D) is arranged in a portion of the first work-piece (10A, 10B) to be the recessed portion (E).

According to the above method, since the material of the first member and the material of the second member are simultaneously press-worked in a state where the corner portion of the material of the second member with a high strength is arranged in the recessed portion of the material of the first member (metal plate 10A), that is, near the center of the press load, it is possible to avoid the inclination of the press machine. Further, since the press working is performed in a state where the corner portion of the second member is introduced in the recessed portion of the first member, a wide press area is not required. Accordingly, the first member and the second member having different strengths can be simultaneously press-worked without significantly increasing the load pressure of the press machine or requiring a large press machine.

Accordingly, it is possible to provide a side panel manufacturing method capable of press working each of the members with a low cost.

The first member (10) may include a front pillar portion (11), a loop pillar portion (12), and a rear fender portion (13), and the second member (20) may include a side sill front portion (21), side sill main portion (22), and a side sill rear portion (23).

A strength of the second work-piece (20A, 20B) may be higher than a strength of the first work-piece (10A, 10B). The press-working step may include a step of disposing the portion of the second work-piece (20A, 20B) to be the corner portion (D) in the portion of the first work-piece (10A, 10B) to be the recessed portion (E) so that the first work-piece (10A, 10B) and the second work-piece (20A, 20B) do not overlap to each other.

The press-working step may further include a step of performing a draw-working simultaneously on the first work-piece (10A) and the second work-piece (20A) which are disposed not to overlap to each other; and a step of performing a shearing-working simultaneously on the first work-piece (10B) and the second work-piece (20B) on which the draw-working has been subjected.

According to the embodiments, it is possible to improve the yield ratio of the material when the press working is performed.

What is claimed is:

1. A manufacturing method of a side panel, wherein the side panel includes a first member and a second member having a higher strength than the first member, the first member and the second member are joined to each other, an opening to which a door is to be mounted is formed in a center part of the side panel, the first member defines a recessed portion to form the opening, and the second member includes a corner portion, the method comprising:

prior to joining the first member and the second member to each other, arranging both of a first work-piece as a material of the first member and a second work-piece as a material of the second member in a single press machine in a state where a portion of the second work-piece to be the corner portion is arranged in a portion of the first work-piece to be the recessed portion; and after arranging both of the first work-piece and the second work-piece in the press machine, simultaneously press-working the first work-piece and the second work-piece in the press machine to form the first member and the second member, wherein the simultaneous press-working of the first work-piece as the material of the first member and the second work-piece as the material of the second member is performed with the portion of the second work-piece to be the corner portion arranged in the portion of the first work-piece to be the recessed portion and at a position of a largest press load that is substantially at a load center of a press area in the press machine performing the simultaneous press-working of the first work-piece as the material of the first member and the second work-piece as the material of the second member.

2. The method according to claim 1, wherein the first member includes a front pillar portion, a loop pillar portion, and a rear fender portion, and wherein the second member includes a side sill front portion, side sill main portion, and a side sill rear portion.

3. The method according to claim 1, further comprising:

after the simultaneous press-working of the first work-piece as the material of the first member and the second work-piece as the material of the second member, joining the first member and the second member to each other.

4. The method according to claim 3, wherein after the simultaneous press-working of the first work-piece as the material of the first member and the second work-piece as the material of the second member, and prior to joining the first member and the second member to each other, rotating the second member.

5. The method according to claim 1, wherein the corner portion of the second member has a higher strength than a remainder of the second member.

6. A manufacturing method of a side panel, wherein the side panel includes a first member and a second member having a higher strength than the first member, the first member and the second member are joined to each other, an opening to which a door is to be mounted is formed in a center part of the side panel, the first member defines a recessed portion to form the opening, and the second member includes a corner portion, the method comprising:

simultaneously press-working a first work-piece as a material of the first member and a second work-piece as a material of the second member in a single press machine, in a state where a portion of the second work-piece to be the corner portion is arranged in a portion of the first work-piece to be the recessed portion, wherein a strength of the second work-piece is higher than a strength of the first work-piece, wherein the press-working includes:

disposing, in the press machine, the portion of the second work-piece to be the corner portion in the portion of the first work-piece to be the recessed portion so that the first work-piece and the second work-piece do not overlap to each other, and wherein the simultaneous press-working of the first work-piece as the material of the first member and the second work-piece as the material of the second member is performed with the portion of the second work-piece to be the corner portion arranged in the portion of the first work-piece to be the recessed portion and at a position of a largest press load that is substantially at a load center of a press area in the press machine performing the simultaneous press-working of the first work-piece as the material of the first member and the second work-piece as the material of the second member.

7. The method according to claim 6, wherein the press-working further includes:

performing a draw-working simultaneously on the first work-piece and the second work-piece which are disposed not to overlap to each other; and performing a shearing-working simultaneously on the first work-piece and the second work-piece on which the draw-working has been subjected.

8. The method according to claim 6, wherein the simultaneous press-working of the first work-piece as the material of the first member and the second work-piece as the material of the second member is performed prior to the first member and the second member being joined to each other.

9. The method according to claim 8, further comprising:

after the simultaneous press-working of the first work-piece as the material of the first member and the second work-piece as the material of the second member, joining the first member and the second member to each other.

10. The method according to claim 9, wherein after the simultaneous press-working of the first work-piece as the material of the first member and the second work-piece as the material of the second member, and prior to joining the first member and the second member to each other, rotating the second member.

11. The method according to claim 6, wherein the corner portion of the second member has a higher strength than a remainder of the second member.

* * * * *